US005274527A

United States Patent [19]

Retzlaff

[11] Patent Number: 5,274,527

[45] Date of Patent: Dec. 28, 1993

[54] HOUSING WITH PLUG-IN CONNECTIONS

[76] Inventor: Werner Retzlaff, Wannweg 8, D-6470 Budingen/Lorbach, Fed. Rep. of Germany

[21] Appl. No.: 812,639

[22] Filed: Dec. 23, 1991

[30] Foreign Application Priority Data

Aug. 22, 1991 [DE] Fed. Rep. of Germany ... 9110614[U]
Sep. 19, 1991 [EP] European Pat. Off. ..... 91115903.6

[51] Int. Cl.[5] ..... H01H 27/06
[52] U.S. Cl. ..... 361/118; 200/43.08
[58] Field of Search ..... 439/133, 134, 304, 367, 439/372, 373; 174/53, 54, 55, 56, 57, 58; 361/111, 118; 200/43.08, 43.05, 43.09, 43.12

[56] References Cited

U.S. PATENT DOCUMENTS 1,212,632 1/1917 Hammond ..... 200/43.08
4,479,688 10/1984 Jennings ..... 339/37
4,647,735 3/1987 Sicher ..... 200/43.08
5,113,311 5/1992 Kamp et al. ..... 439/133

FOREIGN PATENT DOCUMENTS 0443104 8/1991 European Pat. Off. .
3406385 8/1985 Fed. Rep. of Germany .
3807826 9/1989 Fed. Rep. of Germany .
2595532 9/1987 France .

OTHER PUBLICATIONS

European Search Report.

*Primary Examiner*—A. D. Pellinen
*Assistant Examiner*—S. Jackson
*Attorney, Agent, or Firm*—McAulay Fisher Nissen Goldberg & Kiel

[57] ABSTRACT

The invention is directed to a housing for plug-in connections between at least one energy source and a plurality of energy consumers. They are used in the commercial area, e.g. in office and production devices, and in the home, e.g. in video, TV and household appliances. To prevent unauthorized use of such appliances and reduce the risk of injury it is suggested to arrange the plug-in contacts (8) serving to produce the connection on a plane whose surface can be locked with a cover (2). A lock unit (21) which is arranged in the housing (1) so as to be hidden is constructed as locking mechanism (11) and as power switch (5) simultaneously for all connections.

4 Claims, 3 Drawing Sheets

HOUSING WITH PLUG-IN CONNECTIONS

BACKGROUND OF THE INVENTION

Field of the Invention

The invention is directed to a housing for plug-in connections between at least one energy source and a plurality of energy consumers via corresponding source and consumer lines.

Description of the Related Art

Housings of this type are known as so-called connector strips for the connection of a plurality of current consumers with the supply network. These housings often serve to connect a plurality of current-dependent devices with a circuit or energy source in the commercial area, e.g. office and production devices, as well as in the home, e.g. video, TV and household appliances.

There are various possibilities for preventing unauthorized use of such appliances. For example, office equipment, especially in the computer area, is protected against unauthorized access by costly data protection measures.

In the area of the home there are devices which can be closed, e.g. a TV closet. Usually, however, portable household appliances are stored in places not accessible to children so as to eliminate the risk of injury. These measures are complicated and time-consuming so that they are often neglected.

SUMMARY OF THE INVENTION

Along with the increasing demand for highly valuable electronic office and household equipment there arises the necessity of providing a protection system which is universally suited for the various types of appliances and offers protection against unauthorized use as well as protection against accidents with electrical devices.

The object of the present invention is therefore to prevent the described disadvantages and to develop a housing with plug-in connections which offers simple and effective protection against unauthorized use for all energy-dependent office, production, maintenance and household devices.

This object is met according to the invention by constructing a housing to prevent both unauthorized removal of appliances connected via plug-in connections as well as unauthorized use of appliances which are detachably connected with an energy source. The invention includes a housing having plug-in contacts, a locking cover, and a lock unit, wherein placing the lock unit in the locked position with the cover closed engages a rotatable locking arm with a clamp strip to lock the cover in place and interrupts a circuit to prevent power from reaching the plug-in contacts. Placing the lock unit in the unlocked position releases the cover to allow it to be opened and connects the power to the plug-in contacts.

BRIEF DESCRIPTION OF THE DRAWINGS

The invention is explained in more detail with the aid of a number of embodiment examples.

DESCRIPTION OF THE PREFERRED EMBODIMENTS

Figure 1:
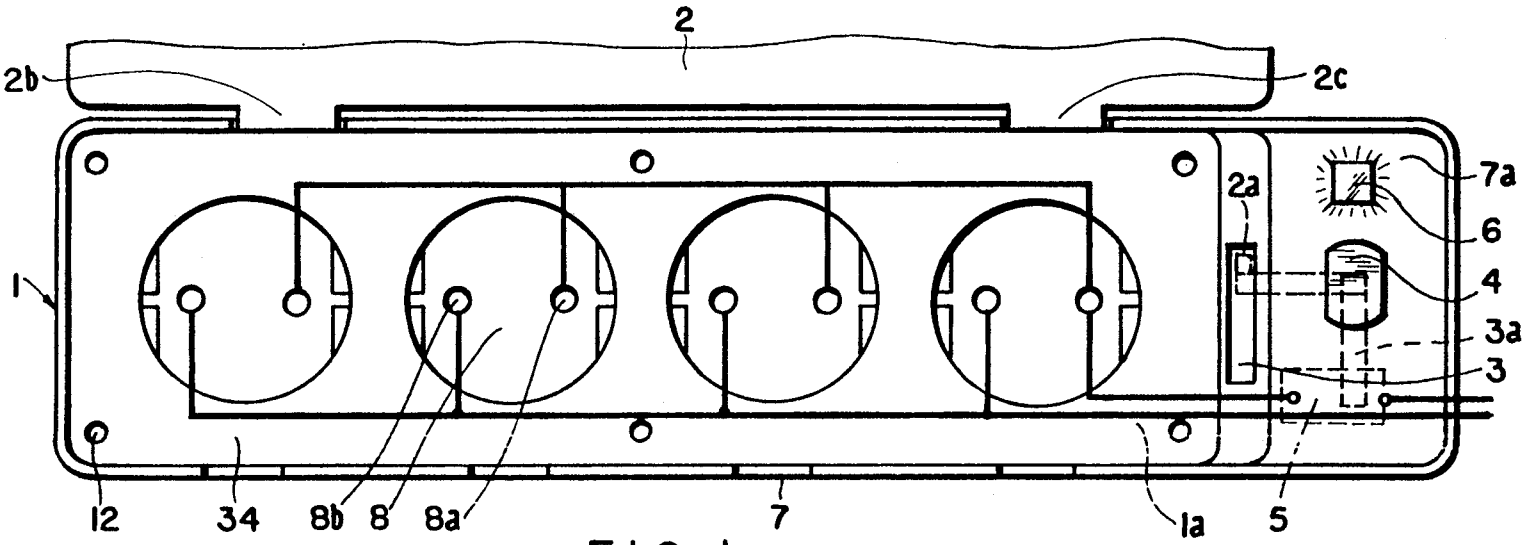
FIG. 1 is a top view of a connector strip according to the invention with folded up cover.

FIG. 1 shows a housing 1 with a cover 2 for plug-in contacts 8, the cover 2 being opened to expose contacts 8.

Opening 3 receives clamp strip 2*a* when the cover 2 is closed. Hook-shaped rotating arm 3*a* may be rotated to engage clamp strip 2*a* to lock the cover in its closed position. Clamp strip 2*a* is positioned so that it is hidden when the cover 2 is closed.

The upper side of the plug-in contacts 8 lies on a planar surface 34 which is screwed to the housing 1 with fastening parts 12. In the opened state of the cover 2 all parts of the housing are easily accessible, the current-carrying parts being especially protected.

Further a lock drive 4 which controls the course of movement of the rotating arm 3*a* between the locked and unlocked positions. When in the locked position, rotating arm 3*a* engages clamp strip 2*a* and power is disconnected from plug-in connectors 8. When in the unlocked position, rotating arm 3*a* releases clamp strip 2*a* and causes flip switch 5 to connect the power to the plug-in connectors 8.

The connector cover 2 is connected with the housing 1 via hinges 2*b*, 2*c*. In the opened state, a plurality of plug-in inserts 8 having two plug-in contacts 8*a, b* are visible. A cut out portion 7 of the connector shafts (not shown) is located in the side area of the housing 1 at the height of the plug-in inserts 8. The surface of every cut out portion is smaller in extent than that of the plug-in inserts 8.

In addition to the connector cover 2, the housing 1 comprises a lock cover 1*a* which contains the circuit unit as well as a lock 11 by which all functions of the circuit unit can be controlled from the outside.

Figure 2:
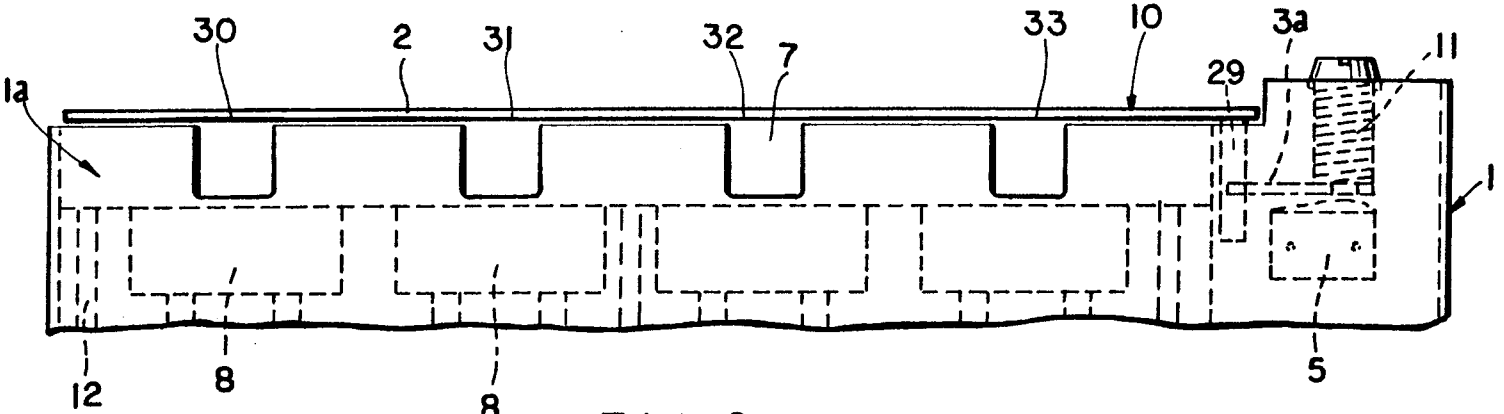
FIG. 2 is a side view, in cross section, of the connector strip according to the invention.

FIG. 2 shows the housing 1 cover 2 in the closed and locked state. The connector cover 2 is located on the upper part 1*a* of the housing 1. Only the cut out portions for the connector shafts 7 are accessible. Their openings are kept small enough so that manipulation or risk of injury is practically excluded.

The plug-in inserts 8 are closed in the state shown in FIG. 2. The fastening parts 12 required for assembling the housing 1 are likewise not accessible from the outside when cover 2 is closed.

According to FIG. 2, the lock drive has a lock 11 whose mechanical construction is made up of a rotating arm 3*a* and can be swiveled from the locking position into the use position. During the swiveling movement the flip switch 5 is switched from off to the on position, respectively. The indicator light 6 immediately shows that the plug-in contacts 8*a, b* are supplied with current when in the unlocked position.

In a preferred embodiment form, the housing according to FIG. 2 contains a connecting rod 10 with cut out portions 30 to 33 which is displaceable against the spring 29 via the rotating arm 3*a* and the lock 11. As a result of this displacement the cut out portion 7 coincides with the cut out portions 30 to 33 in the opened state and the plug-in contacts 8 are accordingly freely accessible. In the locked state, as shown in FIG. 2, the cut out portions 7 are closed by the connecting rod 10.

Figure 3:
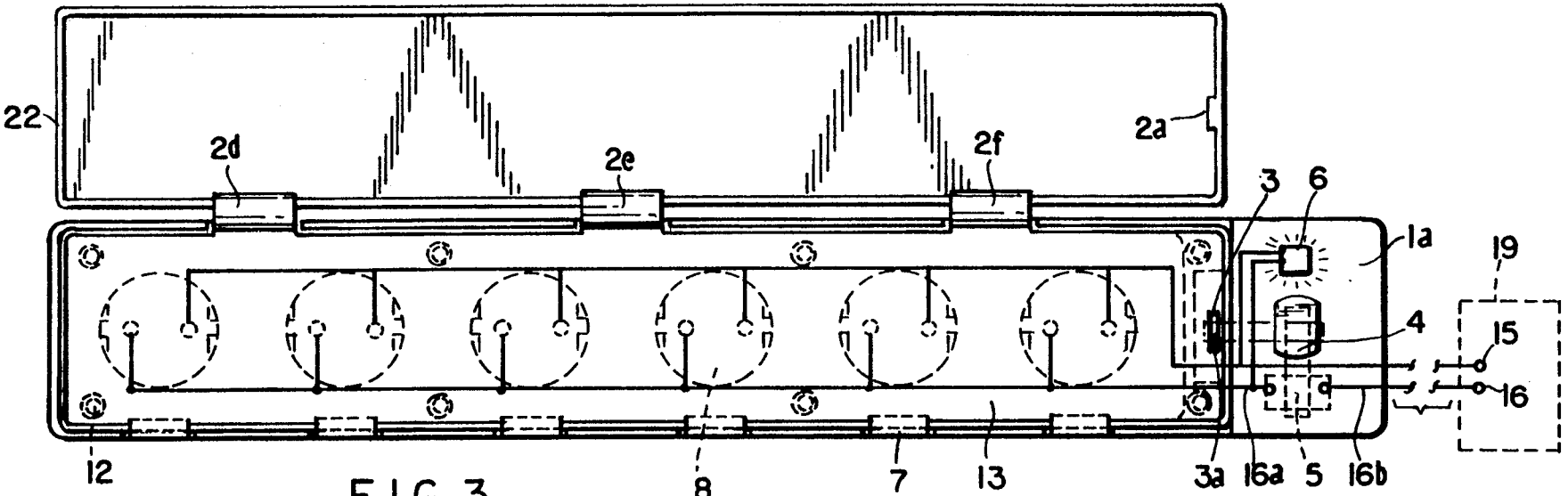
FIG. 3 shows a cross section through the base plate of the connector strip according to the invention corresponding to FIG. 1 with a cover constructed as a box.
Figure 4:
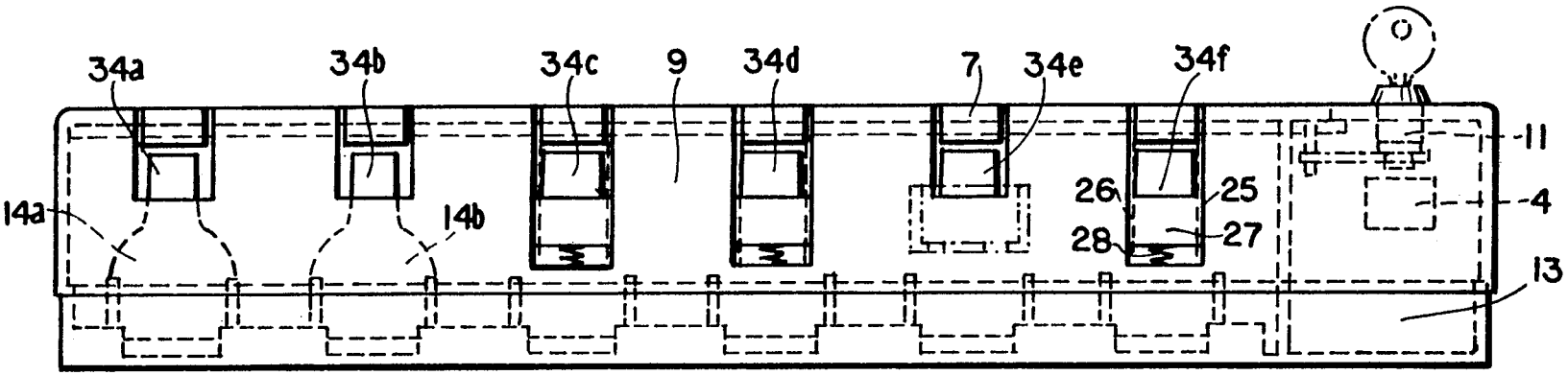
FIG. 4 shows a cross section through the connector strip according to the invention analogous to FIG. 2 with base plate for receiving the plug-in contacts.
Figure 5:
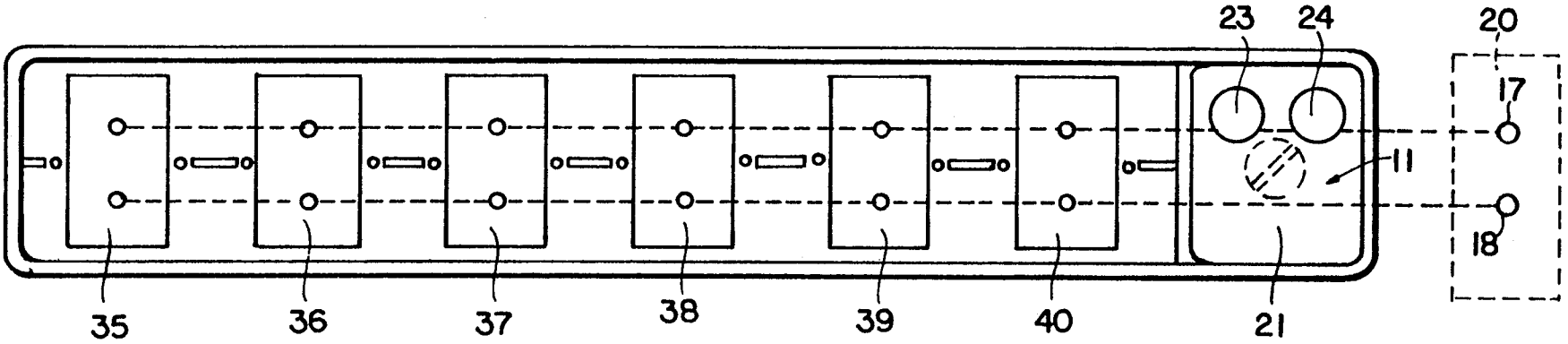
FIG. 5 is a top view of a connector strip according to the invention with altered plug-in contacts.

FIGS. 3, 4 and 5 show another variant of the housing according to the invention, wherein—similar to the construction according to FIG. 2—the cut out portions 7 for the connector shafts 34*a–f* are also closed by the lock drive or are closed automatically. The place of the connecting rod 10 of FIG. 2, however, a closed flap 27 covers the previously open cut out portions 7. The cut out portion 7 is opened by the connector shaft only when a plug connector 14 is placed thereon. Connector shafts 34*a–f* force closing flaps 27 downward when cover 2 is closed. Closing flap 27 works against a spring 28 so that when cover 2 is in the open position flap 27 covers opening 7.

According to FIG. 3, the cover 2 can also be constructed as a closing box 23. This has the advantage that the plug-in contacts 8 can be arranged on a lower plane and the plug connectors 14 can be easily grasped in the exposed housing. The electrical circuit is constructed in FIG. 3, as in the previous examples, in such a way that the entire connector strip is supplied by an energy source 19 via the lines 15, 16.

The switching contact 5 between the partial lines 16*a*, *b* can also be constructed as a light barrier or other electronic switch.

Another kind of circuit is shown by FIG. 5. The current source 20 is connected via the lines 17, 18 with straight current feed to the plug-in contacts 35 to 40. According to a preferred embodiment example, electronic filters 23 and an overload protection 24 are connected in line 15 and prevent an overloading of the housing according to the invention with its connection devices during voltage peaks, e.g. caused by lightening or failure of an electronic component or end consumer appliance.

The examples above are described with reference to rectangular housing parts. But it is also possible to employ other shapes according to the invention in the same way, e.g. round housings. With a round housing it is possible to arrange the locking means centrally, in which case both the current supply and cover are activated via the lock drive.

In the same way, not only current-carrying connections but also pneumatic, hydraulic or electromagnetic systems can be connected. The invention is therefore not limited to the selected concrete embodiment examples.

What is claimed is:

1. A device for providing power to a plurality of energy consumers from at least one energy source comprising:

a housing having a side portion;

contacts positioned within said housing forming a connecting plane, the contacts receiving connectors which connect the contacts to the energy consumers through shafts, wherein the side portion has openings therein which correspond to the positions of the contacts for receiving the shafts, the connectors being unable to fit through the openings;

a cover movably attached to said housing having a clamping strip, the cover having an opened and a closed position, the cover covering the connectors and the connecting plane when in the closed position and exposing the connectors and the connecting plane when in the opened position;

a lock unit positioned within the housing having a locked and an unlocked position, the lock unit comprising:

a locking mechanism having a rotatable shaft;

a rotating arm connected to the rotatable shaft; and, a switch positioned between the energy source and the contacts and being activated by the rotating arm, the switch connecting the energy source to the contacts when the lock unit is in the unlocked position and the switch disconnecting the energy source from the contacts when the lock unit is in the locked position;

wherein the rotating arm engages the clamping strip to hold the cover closed when the lock unit is in the locked position preventing the removal of the connectors from an area between the cover and the connecting plane;

wherein the rotating arm releases the clamping strip to allow the cover to be opened and the connectors to be removed when the lock unit is in the unlocked position;

further comprising cut-out portions positioned within the side portion, the cut-out portions positioned to receive shafts of the connectors and being sized to prevent removal of the connector when the cover is in the closed position; and further comprising flaps for closing the cut-out portions, the cut-out portions having guides for sliding the flaps.

2. The device of claim 1, further comprising springs which bias the flaps in a direction for closing the cut-out portions.

3. A device for providing power to a plurality of energy consumers from at least one energy source comprising:

a housing having a side portion;

contacts positioned within said housing forming a connecting plane, the contacts receiving connectors which connect the contacts to the energy consumers through shafts, wherein the side portion has openings therein which correspond to the positions of the contacts for receiving the shafts, the connectors being unable to fit through the openings;

a cover movably attached to said housing having a clamping strip, the cover having an opened and a closed position, the cover covering the connectors and the connecting plane when in the closed position and exposing the connectors and the connecting plane when in the opened position;

a lock unit positioned within the housing having a locked and an unlocked position, the lock unit comprising:

a locking mechanism having a rotatable shaft;

a rotating arm connected to the rotatable shaft; and, a switch positioned between the energy source and the contacts and being activated by the rotating arm, the switch connecting the energy source to the contacts when the lock unit is in the unlocked position and the switch disconnecting the energy source from the contacts when the lock unit is in the locked position;

an electronic filter connected between the switch and the contacts;

an overload protection device connected between the switch and the contacts; and an indicator light, positioned within said housing and connected between the switch and the contacts for indicating when power is supplied to the contacts;

wherein flaps are provided for covering the openings;

wherein the rotating arm engages the clamping strip to hold the cover closed when the lock unit is in the locked position preventing the removal of the connectors from an area between the cover and the connecting plane; and, wherein the rotating arm releases the clamping strip to allow the cover to be opened and the connectors to be removed when the lock unit is in the unlocked position.

4. A device for providing power to a plurality of energy consumers from at least one energy source comprising:

a housing having a side portion;

contacts positioned within said housing forming a connecting plane, the contacts receiving connectors which connect the contacts to the energy consumers through shafts, wherein the side portion has openings therein which correspond to the positions of the contacts for receiving the shafts, the connectors being unable to fit through the openings;

a cover movably attached to said housing having a clamping strip, the cover having an opened and a closed position, the cover covering the connectors and the connecting plane when in the closed position and exposing the connectors and the connecting plane when in the closed position;

a lock unit positioned within the housing having a locked and an unlocked position, the lock unit comprising:

a locking mechanism having a rotatable shaft;

a rotating arm connected to the rotatable shaft; and, a switch positioned between the energy source and the contacts and being activated by the rotating arm, the switch connecting the energy source to the contacts when the lock unit is in the unlocked position and the switch disconnecting the energy source from the contacts when the lock unit is in the locked position;

wherein the rotating arm engages the clamping strip to hold the cover closed when the lock unit is in the locked position preventing the removal of the connectors from an area between the cover and the connecting plane;

wherein the rotating arm releases the clamping strip to allow the cover to be opened and the connectors to be removed when the lock unit is in the unlocked position; and wherein additional electronic components are arranged within the housing which include a filter and an overload protection device, the components being arranged between the switch and the contacts.

* * * * *